US012281656B1

(12) United States Patent
Zhu

(10) Patent No.: US 12,281,656 B1
(45) Date of Patent: Apr. 22, 2025

(54) NECK FAN

(71) Applicant: Guangdong Aoyun Technology Co., Ltd., Guangdong (CN)

(72) Inventor: Xueping Zhu, Guangdong (CN)

(73) Assignee: Guangdong Aoyun Technology Co., Ltd.

( * ) Notice: Subject to any disclaimer, the term of this patent is extended or adjusted under 35 U.S.C. 154(b) by 0 days.

(21) Appl. No.: 18/421,213

(22) Filed: Jan. 24, 2024

(30) Foreign Application Priority Data

Jan. 16, 2024 (CN) ..... 202420112981.8

(51) Int. Cl.

| | |
|---|---|
| ***F04D 25/16*** | (2006.01) |
| ***A41D 13/002*** | (2006.01) |
| ***F04D 25/06*** | (2006.01) |
| ***F04D 29/54*** | (2006.01) |
| ***F04D 29/64*** | (2006.01) |

(52) U.S. Cl.
CPC ..... *F04D 25/166* (2013.01); *A41D 13/0025* (2013.01); *F04D 25/0673* (2013.01); *F04D 29/542* (2013.01); *F04D 29/646* (2013.01); *F24F 2221/38* (2013.01)

(58) Field of Classification Search
CPC ..... F24F 2221/38; F04D 25/166; F04D 25/0673; A41D 13/0025; A41D 20/005; A42B 3/286
USPC ..... 417/234
See application file for complete search history.

(56) References Cited

U.S. PATENT DOCUMENTS

| | | | | |
|---|---|---|---|---|
| 11,703,060 | B1 * | 7/2023 | Song | F04D 29/281 415/60 |
| 2017/0370596 | A1 * | 12/2017 | Lee | A42B 3/286 |
| 2021/0355960 | A1 * | 11/2021 | Liu | F04D 25/0673 |
| 2021/0368872 | A1 * | 12/2021 | Lee | F04D 25/084 |
| 2022/0106962 | A1 * | 4/2022 | Staszak | F04D 19/002 |

* cited by examiner

*Primary Examiner* — Kenneth J Hansen

(57) ABSTRACT

The present disclosure provides a neck fan. The neck fan includes a hanging shell and a first fan assembly. The hanging shell includes an inner end portion that is in contact with the neck. A first air guide chamber having a first central axis is arranged on the hanging shell in a protruding manner. The first air guide chamber includes a first air inlet arranged at a lower end portion of the hanging shell and a first air outlet opposite to the first air inlet. The first air outlet is oriented towards the inner end portion. Both the first air inlet and the first air outlet are located on the first central axis. The first fan assembly is located in the first air guide chamber. And the first fan assembly is configured to drive an air flow to flow from the first air inlet to the first air outlet.

19 Claims, 5 Drawing Sheets

NECK FAN

CROSS-REFERENCE TO RELATED APPLICATIONS

The application claims priority of Chinese patent application CN2024201129818, filed on Jan. 16, 2024, which is incorporated herein by reference in its entireties.

TECHNICAL FIELD

The present disclosure relates to the field of fans, and in particular, to a neck fan.

BACKGROUND

As portable cooling equipment, a portable fan has received widespread attentions and been widely applied in hot seasons in recent years, especially a neck fan. The neck fan can be carried around and free the hands, and are favored by the majority of users.

However, as people continue to pursue comfortable experiences, they have gradually an increasing expectation for the performance of the neck fan. In the scorching summer, users hope to achieve a faster and more direct cooling effect in a high-temperature environment, but the design of the traditional neck fan fails to fully meet this demand.

For this purpose, the present disclosure provides a neck fan that allows air from the fan to be blown more directly and centrally towards a user, thereby providing a more comfortable user experience in a hot environment. According to this design, the cooling effect of the neck fan is improved while the portability is achieved, so that the growing demand of the user for personalized and efficient cooling equipment is met.

SUMMARY

In order to overcome the shortcomings of the prior art, the present disclosure provides a neck fan that allows air from the fan to be blown more directly and centrally towards a user, thereby providing a more comfortable user experience in a hot environment and is convenient for the user to carry.

The technical solution adopted by the present disclosure to solve the technical problem is as follows.

The present disclosure provides a neck fan, includes: a hanging shell, wherein the hanging shell includes an inner end portion that is in contact with the neck; a first air guide chamber having a first central axis is arranged on the hanging shell in a protruding manner; the first air guide chamber includes a first air inlet arranged at a lower end portion of the hanging shell and a first air outlet opposite to the first air inlet; the first air outlet is oriented towards the inner end portion; both the first air inlet and the first air outlet are located on the first central axis; and a first fan assembly, wherein the first fan assembly is located in the first air guide chamber; and the first fan assembly is configured to drive an air flow to flow from the first air inlet to the first air outlet.

As the improvement of the present disclosure, a second air guide chamber having a second central axis is further arranged on the hanging shell in a protruding manner; the second air guide chamber includes a second air inlet arranged at the lower end portion of the hanging shell and a second air outlet opposite to the second air inlet; the second air outlet is oriented towards the inner end portion; and both the second air inlet and the second air outlet are located on the second central axis.

As the improvement of the present disclosure, the neck fan further includes a second fan assembly, wherein the second fan assembly is located in the second air guide chamber, and the second fan assembly is configured to drive the air flow to flow from the second air inlet to the second air outlet.

As the improvement of the present disclosure, the first air guide chamber is further provided with a first air guide vane group; the first air guide vane group is located at the first air outlet; and the first air guide vane group is configured to adjust an air outlet direction at the first air outlet.

As the improvement of the present disclosure, the first air guide vane group includes at least two first air guide vanes.

As the improvement of the present disclosure, the second air guide chamber is further provided with a second air guide vane group; the second air guide vane group is located at the second air outlet; and the second air guide vane group is configured to adjust an air outlet direction at the second air outlet.

As the improvement of the present disclosure, the second air guide vane group includes at least two second air guide vanes.

As the improvement of the present disclosure, a diameter of the first air inlet is within a range of 30 mm to 60 mm, and a diameter of the first air outlet is within a range of 30 mm to 60 mm.

As the improvement of the present disclosure, the neck fan further includes a first power supply assembly, wherein the first power supply assembly is located inside the hanging shell; the first power supply assembly is electrically connected to the first fan assembly to supply power to the first fan assembly; the first power supply assembly includes a first battery and a first circuit board; and the first battery is electrically connected to the first circuit board to supply power to the first circuit board.

As the improvement of the present disclosure, the neck fan further includes a second power supply assembly, wherein the second power supply assembly is located inside the hanging shell; the second power supply assembly is electrically connected to the second fan assembly to provide power to the second fan assembly; the second power supply assembly includes a second battery and a second circuit board; and the second battery is electrically connected to the second circuit board to provide power to the second circuit board.

As the improvement of the present disclosure, the first fan assembly includes a first fan shell, a first motor fixedly mounted inside the first fan shell, and a first fan blade mounted on a rotating shaft of the first motor; the first fan shell is provided with a third air inlet, a first air duct, and a third air outlet; and the first air inlet, the third air inlet, the first air duct, the third air outlet, the first air guide chamber, and the first air outlet are connected to each other in sequence.

As the improvement of the present disclosure, the first air inlet and the third air inlet are connected to a first air inlet hood; the first air inlet hood is provided with several first air inlet holes; the first air outlet and the third air outlet are connected to a first air outlet hood; and the first air outlet hood is provided with several first air outlet holes.

As the improvement of the present disclosure, the second fan assembly includes a second fan shell, a second motor fixedly mounted inside the second fan shell, and a second fan blade mounted on a rotating shaft of the second motor; the second fan shell is provided with a fourth air inlet, a second air duct, and a fourth air outlet; and the second air inlet, the fourth air inlet, the second air duct, the fourth air outlet, the second air guide chamber, and the first air outlet are connected to each other in sequence.

As the improvement of the present disclosure, the second air inlet and the fourth air inlet are connected to a second air inlet hood; the second air inlet hood is provided with several second air inlet holes; the second air outlet and the fourth air outlet are connected to a second air outlet hood; and the second air outlet hood is provided with several second air outlet holes.

As the improvement of the present disclosure, the hanging shell is a U-shaped hanging shell; the hanging shell includes a first bracket and a second bracket; and the first bracket is detachably connected to the second bracket.

As the improvement of the present disclosure, the first air guide chamber is located inside the first bracket; the first bracket is further provided with a first mounting chamber; and the first power supply assembly is located inside the first mounting chamber.

As the improvement of the present disclosure, the second air guide chamber is located inside the second bracket; the second bracket is further provided with a second mounting chamber; and the second power supply assembly is located inside the second mounting chamber.

As the improvement of the present disclosure, the first bracket is further provided with a first button switch, a first charging interface, and a first indicator lamp module; and the first button switch, the first charging interface, and the first indicator lamp module are all electrically connected to the first power supply assembly.

As the improvement of the present disclosure, the second bracket is further provided with a second button switch, a second charging interface, and a second indicator lamp module; and the second button switch, the second charging interface, and the second indicator lamp module are all electrically connected to the second power supply assembly.

As the improvement of the present disclosure, the inner end portion is connected to at least one flexible cushion.

The present disclosure has the following beneficial effects. The present disclosure provides a neck fan includes: a hanging shell, wherein the hanging shell includes an inner end portion that is in contact with the neck; a first air guide chamber having a first central axis is arranged on the hanging shell in a protruding manner; the first air guide chamber includes a first air inlet arranged at a lower end portion of the hanging shell and a first air outlet opposite to the first air inlet; the first air outlet is oriented towards the inner end portion; both the first air inlet and the first air outlet are located on the first central axis; and a first fan assembly, wherein the first fan assembly is located in the first air guide chamber; and the first fan assembly is configured to drive an air flow to flow from the first air inlet to the first air outlet. Through the above structure, the first air inlet and the first air outlet are coaxially arranged to form a straight blowing fan that blows air in a vertical direction, so that the first fan assembly can drive the air flow to quickly flow from the first air inlet and be blown out from the first air outlet, which effectively improves the air blowing efficiency. When using a neck fan, a user can more directly feel cool air. This improves the overall performance of the fan. Furthermore, since the first air guide chamber integrally protrude out of the hanging shell, this design improves the overall sense of beauty and sense of design of the product, helps to improve the wearing comfort of the neck fan, and improves the overall quality and user experience of the product.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
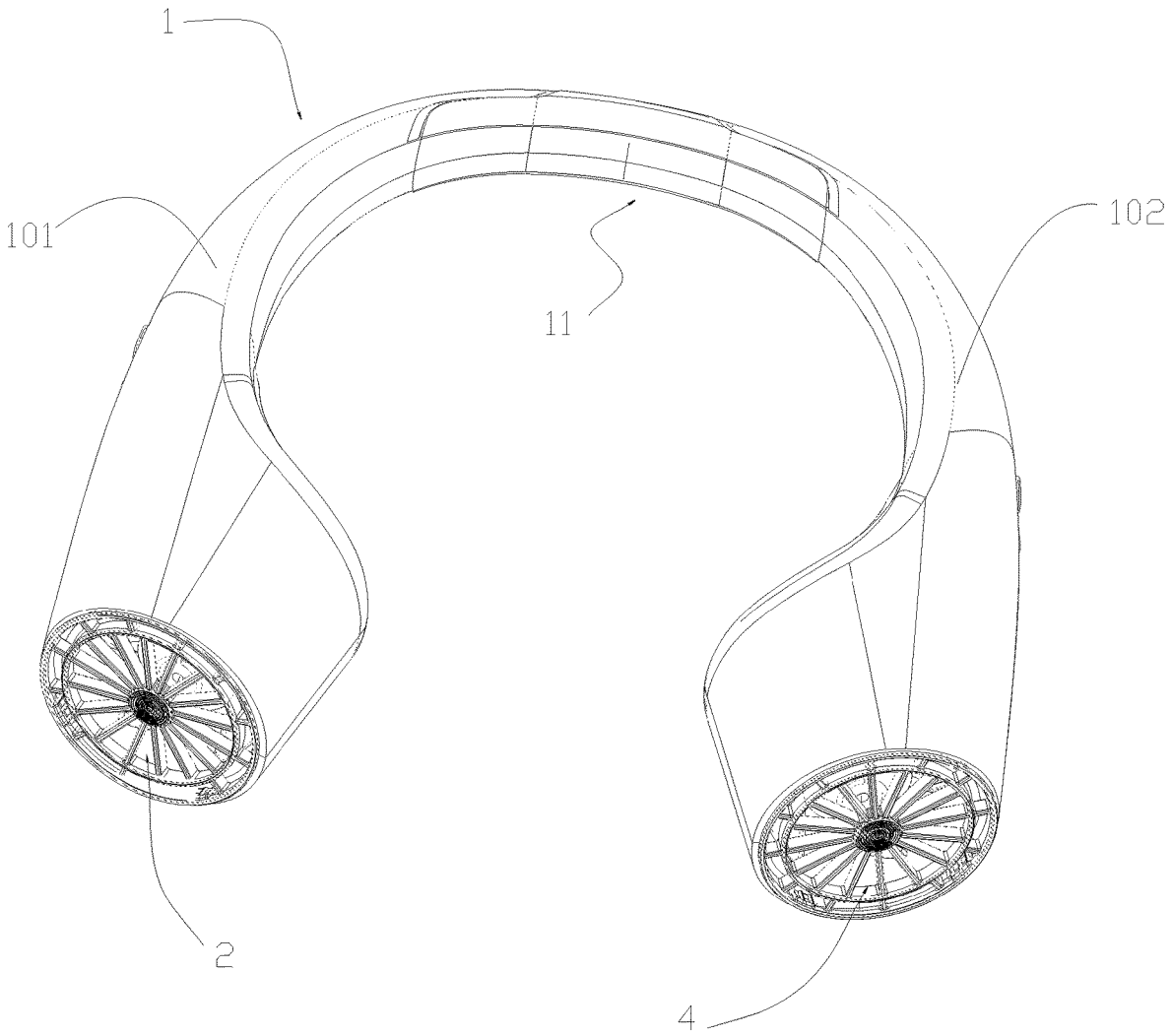
FIG. 1 is a schematic diagram of an entire structure of the present disclosure.
Figure 2:
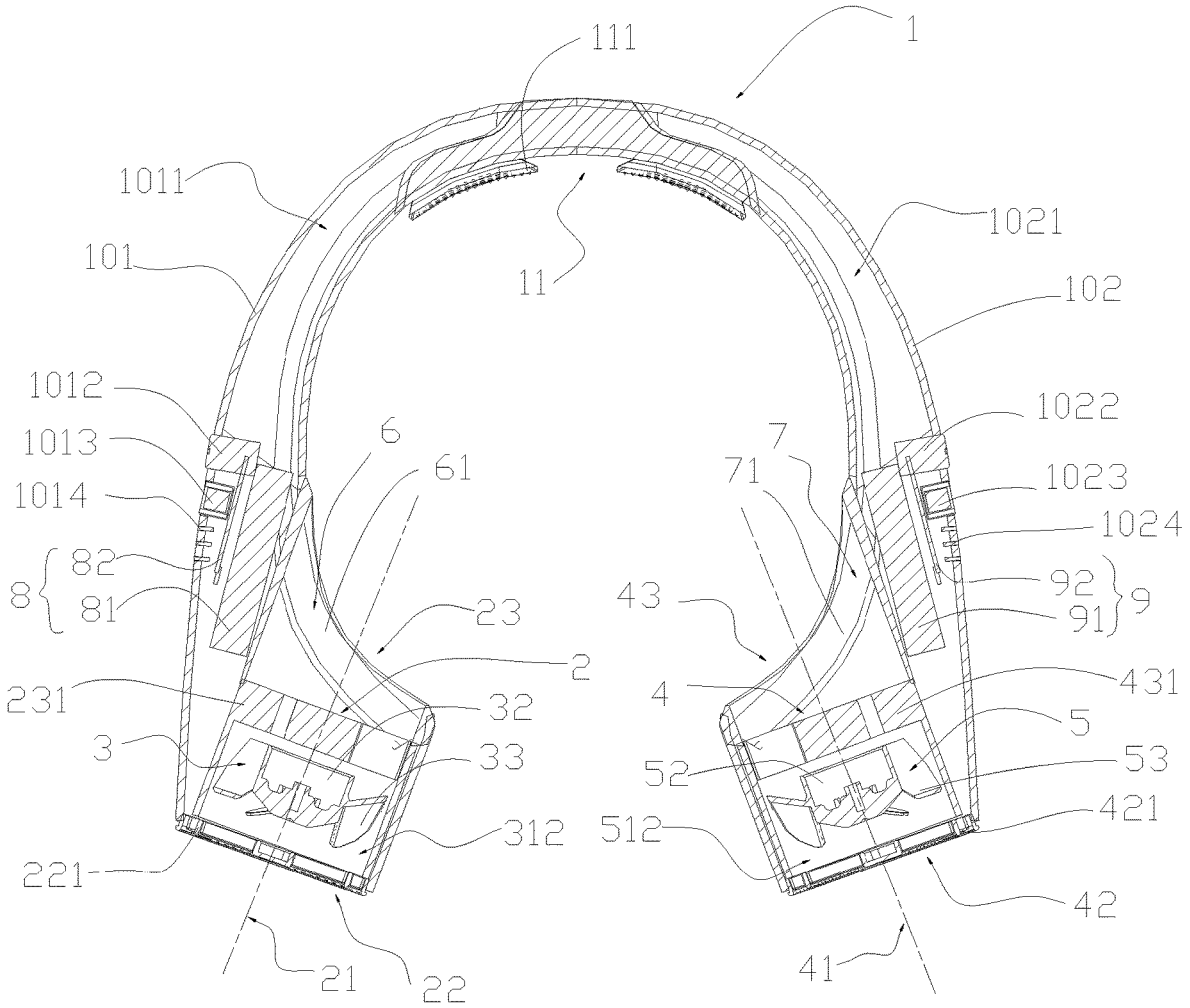
FIG. 2 is cross-sectional view of the present disclosure.
Figure 3:
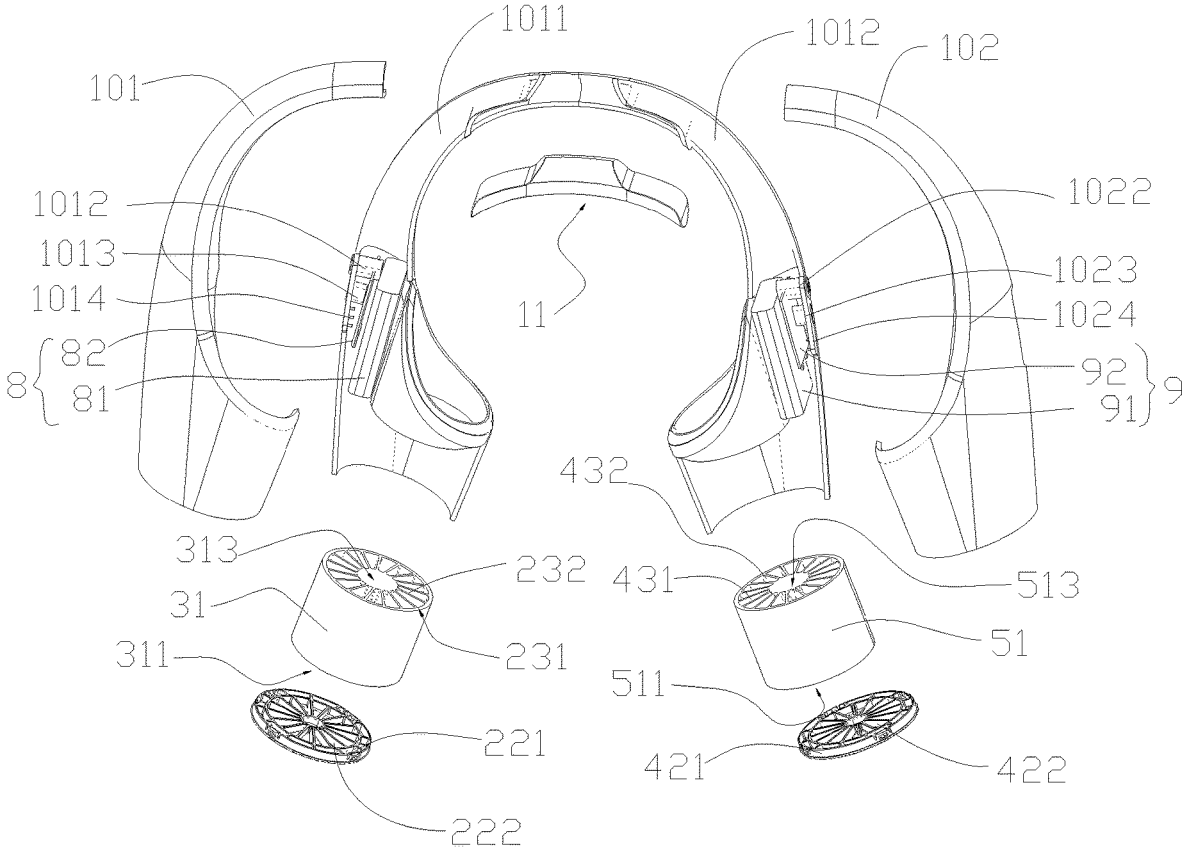
FIG. 3 is an exploded view of the present disclosure.
Figure 4:
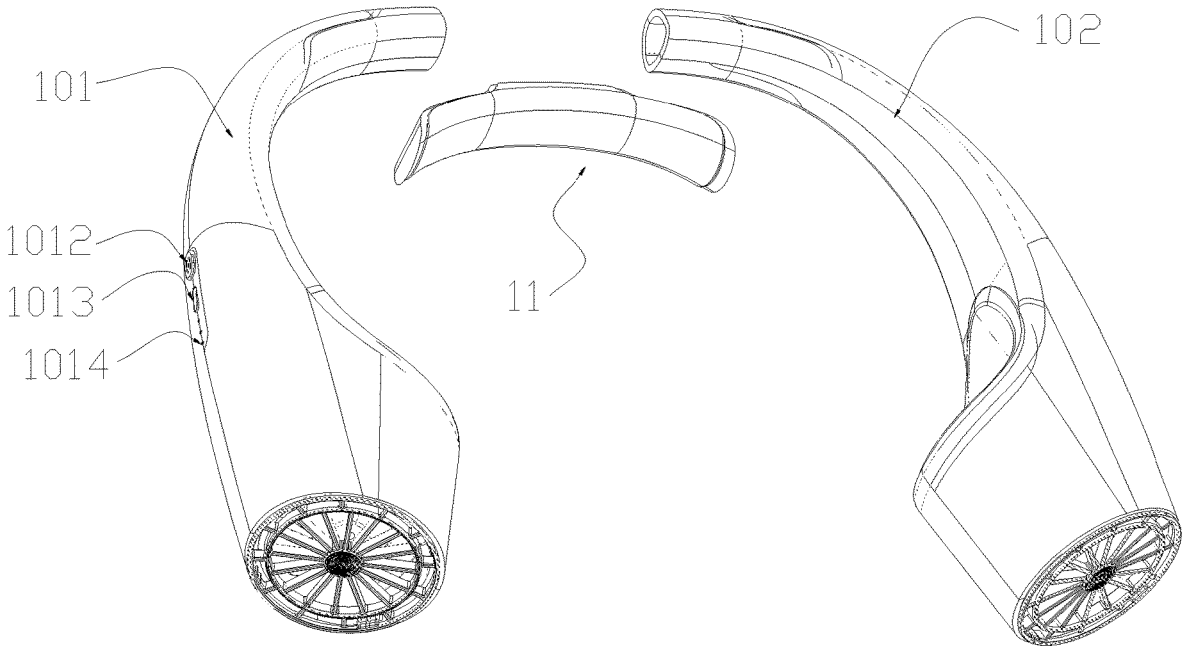
FIG. 4 is another exploded view of the present disclosure.
Figure 5:
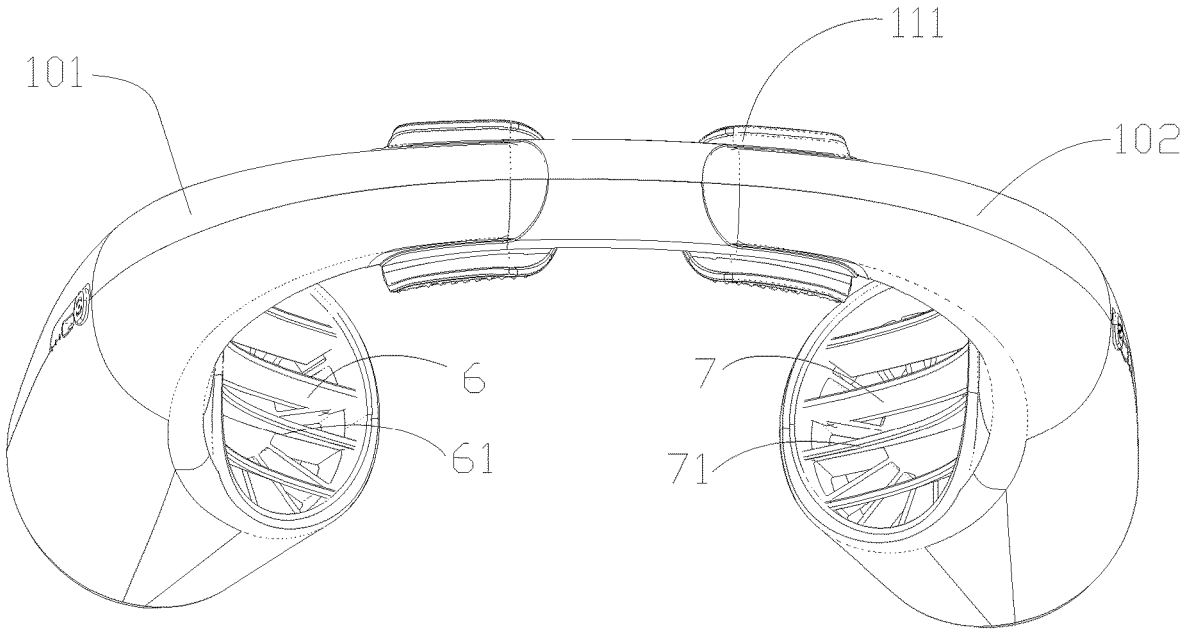
FIG. 5 is a schematic diagram of an entire structure in another viewing angle of the present disclosure.

Referring to FIG. 1 to FIG. 5, a neck fan includes: a hanging shell 1, wherein the hanging shell 1 includes an inner end portion 11 that is in contact with the neck; a first air guide chamber 2 having a first central axis 21 is arranged on the hanging shell 1 in a protruding manner; the first air guide chamber 2 includes a first air inlet 22 arranged at a lower end portion of the hanging shell 1 and a first air outlet 23 opposite to the first air inlet 22; the first air outlet 23 is oriented towards the inner end portion 11; both the first air inlet 22 and the first air outlet 23 are located on the first central axis 21; and a first fan assembly 3, wherein the first fan assembly 3 is located in the first air guide chamber 2; and the first fan assembly 3 is configured to drive an air flow to flow from the first air inlet 22 to the first air outlet 23. Through the above structure, the first air inlet 22 and the first air outlet 23 are coaxially arranged to form a straight blowing fan that blows air in a vertical direction, so that the first fan assembly 3 can drive the air flow to quickly flow from the first air inlet 22 and be blown out from the first air outlet 23, which effectively improves the air blowing efficiency. When using a neck fan, a user can more directly feel cool air. This improves the overall performance of the fan. Furthermore, since the first air guide chamber 2 integrally protrude out of the hanging shell 1, this design improves the overall sense of beauty and sense of design of the product, helps to improve the wearing comfort of the neck fan, and improves the overall quality and user experience of the product.

In this embodiment, a second air guide chamber 4 having a second central axis 41 is further arranged on the hanging shell 1 in a protruding manner; the second air guide chamber 4 includes a second air inlet 42 arranged at the lower end portion of the hanging shell 1 and a second air outlet 43 opposite to the second air inlet 42; the second air outlet 43 is oriented towards the inner end portion 11; and both the second air inlet 42 and the second air outlet 43 are located on the second central axis 41. The neck fan further includes a second fan assembly 5, wherein the second fan assembly 5 is located in the second air guide chamber 4, and the second fan assembly 5 is configured to drive the air flow to flow from the second air inlet 42 to the second air outlet 43. Through the above structure, the second air inlet 42 and the second air outlet 43 are coaxially arranged to form a straight blowing fan that blows air in a vertical direction, so that the second fan assembly 5 can drive the air flow to quickly flow from the second air inlet 42 and be blown out from the second air outlet 43, which effectively improves the air blowing efficiency. When using a neck fan, a user can more directly feel cool air. This improves the overall performance of the fan. Furthermore, since the second air guide chamber 4 integrally protrude out of the hanging shell 1, this design improves the overall beauty and sense of design of the product, helps to improve the wearing comfort of the neck fan, and improves the overall quality and user experience of the product.

In this embodiment, the first air guide chamber 2 is further provided with a first air guide vane group 6; the first air guide vane group 6 is located at the first air outlet 23; and the first air guide vane group 6 is configured to adjust an air outlet direction at the first air outlet 23. Specifically, the first air guide vane group 6 includes at least two first air guide vanes 61. Through the above structure, an air outlet air flow can be better adjusted to avoid direct blowing of strong wind towards the face or neck, thereby slowing down the wind and providing a more personalized and comfortable user experience.

In this embodiment, the second air guide chamber 4 is further provided with a second air guide vane group 7; the second air guide vane group 7 is located at the second air outlet 43; and the second air guide vane group 7 is configured to adjust an air outlet direction at the second air outlet 43. Specifically, the second air guide vane group includes at least two second air guide vanes 71. Through the above structure, an air outlet air flow can be better adjusted to avoid direct blowing of strong wind towards the face or neck, thereby slowing down the wind and providing a more personalized and comfortable user experience.

In this embodiment, a diameter of the first air inlet 22 is within a range of 30 mm to 60 mm, and a diameter of the first air outlet 23 is within a range of 30 mm to 60 mm. Through the above structure, an appropriate diameter range helps to achieve a balanced air flowrate, so that the fan can provide a sufficient air flow and maintain a good cooling effect. Furthermore, it helps to rationalize the overall structure, and the neck fan is convenient to carry and use.

In this embodiment, the neck fan further includes a first power supply assembly 8, wherein the first power supply assembly 8 is located inside the hanging shell 1; the first power supply assembly 8 is electrically connected to the first fan assembly 3 to supply power to the first fan assembly 3; the first power supply assembly 8 includes a first battery 81 and a first circuit board 82; and the first battery 81 is electrically connected to the first circuit board 82 to supply power to the first circuit board 82. Through the above structure, the first power supply assembly 8 is arranged inside the hanging shell 1. This design can improve the overall appearance of the neck fan and effectively supply power to the first fan assembly 3, to ensure the reliability of the product.

In this embodiment, the neck fan further includes a second power supply assembly 9, wherein the second power supply assembly 9 is located inside the hanging shell 1; the second power supply assembly 9 is electrically connected to the second fan assembly 5 to provide power to the second fan assembly 5; the second power supply assembly 9 includes a second battery 91 and a second circuit board 92; and the second battery 91 is electrically connected to the second circuit board 92 to provide power to the second circuit board 92. Through the above structure, the second power supply assembly 9 is arranged inside the hanging shell 1. This design can improve the overall appearance of the neck fan and effectively supply power to the second fan assembly 5, to ensure the reliability of the product.

In this embodiment, the first fan assembly 3 includes a first fan shell 31, a first motor 32 fixedly mounted inside the first fan shell 31, and a first fan blade 33 mounted on a rotating shaft of the first motor 32; the first fan shell 31 is provided with a third air inlet 311, a first air duct 312, and a third air outlet 313; and the first air inlet 22, the third air inlet 311, the first air duct 312, the third air outlet 313, the first air guide chamber 2, and the first air outlet 23 are connected to each other in sequence.

Further, the first air inlet 22 and the third air inlet 311 are connected to a first air inlet hood 221; the first air inlet hood 221 is provided with several first air inlet holes 222; the first air outlet 23 and the third air outlet 313 are connected to a first air outlet hood 231; and the first air outlet hood 231 is provided with several first air outlet holes 232. Through the above structure, a direction of the air flow is effectively achieved. The design of the first air inlet hood 221 and the first air outlet hood 231 is conducive to preventing other debris, such as hairs and paper scraps, from being sucked into the fan, which is conducive to maintaining the safety of the fan.

In this embodiment, the second fan assembly 5 includes a second fan shell 51, a second motor 52 fixedly mounted inside the second fan shell 51, and a second fan blade 53 mounted on a rotating shaft of the second motor 52; the second fan shell 51 is provided with a fourth air inlet 511, a second air duct 512, and a fourth air outlet 513; and the second air inlet 42, the fourth air inlet 511, the second air duct 512, the fourth air outlet 513, the second air guide chamber 4, and the first air outlet 23 are connected to each other in sequence.

Further, the second air inlet 42 and the fourth air inlet 511 are connected to a second air inlet hood 421; the second air inlet hood 421 is provided with several second air inlet holes 422; the second air outlet 43 and the fourth air outlet 513 are connected to a second air outlet hood 431; and the second air outlet hood 431 is provided with several second air outlet holes 432. Through the above structure, a direction of the air flow is effectively achieved. The design of the first air inlet hood 221 and the first air outlet hood 231 is conducive to preventing other debris, such as hairs and paper scraps, from being sucked into the fan, which is conducive to maintaining the safety of the fan.

In this embodiment, the hanging shell 1 is a U-shaped hanging shell 1; the hanging shell 1 includes a first bracket 101 and a second bracket 102; and the first bracket 101 is detachably connected to the second bracket 102. Through the above structure, since the hanging shell 1 can be disassembled into the first bracket 101 and the second bracket 102, a user can choose to fix the first bracket 101 and the second bracket 102 together and use them as a neck fan, or can disassemble the first bracket and the second bracket and use them as independent small fans. This design brings higher flexibility, and the user can select an appropriate usage method according to a specific need. Furthermore, after disassembling, the neck fan is convenient to carry. The user can put one of the fans into a pocket or a bag and enjoy the cool anytime and anywhere, which improves the portability and practicality of the product and improves the user experience.

Specifically, the first air guide chamber 2 is located inside the first bracket 101; the first bracket 101 is further provided with a first mounting chamber 1011; and the first power supply assembly 8 is located inside the first mounting chamber 1011. The second air guide chamber 4 is located inside the second bracket 102; the second bracket 102 is further provided with a second mounting chamber 1021; and the second power supply assembly 9 is located inside the second mounting chamber 1021. Through the above structure, the neck fan is effectively detachable and can be used as an independent small fan.

Further, the first bracket 101 is further provided with a first button switch 1012, a first charging interface 1013, and a first indicator lamp module 1014; and the first button switch 1012, the first charging interface 1013, and the first indicator lamp module 1014 are all electrically connected to the first power supply assembly 8. The second bracket 102 is further provided with a second button switch 1022, a second charging interface 1023, and a second indicator lamp module 1024; and the second button switch 1022, the second charging interface 1023, and the second indicator lamp module 1024 are all electrically connected to the second power supply assembly 9. Through the above structure, when the use uses the independent small fans, the user can use the independent button switches for control, and the indicator lamp modules can display on and off of the fans and fan levels, which brings higher flexibility and allowing the user to select an appropriate usage method according to a specific need.

In this implementation, the inner end portion 11 is connected to at least one flexible cushion 111. Specifically, there can be two or three flexible cushions 111. Through the above structure, a silica gel cushion can provide a soft and elastic fitting sense, so that the user feels more comfortable when the neck fan abuts against the neck of the user. This comfort helps to reduce the discomfort of the user when the user wears the neck fan and improve the overall wearing comfort. The silica gel cushion can provide a buffering effect to a certain extent, which helps to reduce a pressure on the skin, which applied by a portion of the neck fan that is in contact with the neck. This can reduce potential discomfort of users who wear the neck fan for a long time, especially when the users use the neck fan in sports or daily activities.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A neck fan, comprising:

a hanging shell, wherein the hanging shell comprises an inner end portion; a first air guide chamber having a first central axis is arranged on the hanging shell in a protruding manner; the first air guide chamber comprises a first air inlet arranged at a lower end portion of the hanging shell and a first air outlet opposite to the first air inlet; the first air outlet is oriented towards the inner end portion; both the first air inlet and the first air outlet are located on the first central axis; and a first fan assembly, wherein the first fan assembly is located in the first air guide chamber; and the first fan assembly is configured to drive an air flow to flow from the first air inlet to the first air outlet, wherein the first fan assembly comprises a first fan shell, a first motor fixedly mounted inside the first fan shell, and a first fan blade mounted on a rotating shaft of the first motor; the first fan shell is provided with a third air inlet, a first air duct, and a third air outlet; and the first air inlet, the third air inlet, the first air duct, the third air outlet, the first air guide chamber, and the first air outlet are connected to each other in sequence.

2. The neck fan according to claim 1, wherein a second air guide chamber having a second central axis is further arranged on the hanging shell in a protruding manner; the second air guide chamber comprises a second air inlet arranged at the lower end portion of the hanging shell and a second air outlet opposite to the second air inlet; the second air outlet is oriented towards the inner end portion; and both the second air inlet and the second air outlet are located on the second central axis.

3. The neck fan according to claim 2, further comprising a second fan assembly, wherein the second fan assembly is located in the second air guide chamber, and the second fan assembly is configured to drive the air flow to flow from the second air inlet to the second air outlet.

4. The neck fan according to claim 1, wherein the first air guide chamber is further provided with a first air guide vane group; the first air guide vane group is located at the first air outlet; and the first air guide vane group is configured to adjust an air outlet direction at the first air outlet.

5. The neck fan according to claim 4, wherein the first air guide vane group comprises at least two first air guide vanes.

6. The neck fan according to claim 2, wherein the second air guide chamber is further provided with a second air guide vane group; the second air guide vane group is located at the second air outlet; and the second air guide vane group is configured to adjust an air outlet direction at the second air outlet.

7. The neck fan according to claim 6, wherein the second air guide vane group comprises at least two second air guide vanes.

8. The neck fan according to claim 1, wherein a diameter of the first air inlet is within a range of 30 mm to 60 mm, and a diameter of the first air outlet is within a range of 30 mm to 60 mm.

9. The neck fan according to claim 1, further comprising a first power supply assembly, wherein the first power supply assembly is located inside the hanging shell; the first power supply assembly is electrically connected to the first fan assembly to supply power to the first fan assembly; the first power supply assembly comprises a first battery and a first circuit board; and the first battery is electrically connected to the first circuit board to supply power to the first circuit board.

10. The neck fan according to claim 3, further comprising a second power supply assembly, wherein the second power supply assembly is located inside the hanging shell; the second power supply assembly is electrically connected to the second fan assembly to provide power to the second fan assembly; the second power supply assembly comprises a second battery and a second circuit board; and the second battery is electrically connected to the second circuit board to provide power to the second circuit board.

11. The neck fan according to claim 1, wherein the first air inlet and the third air inlet are connected to a first air inlet hood; the first air inlet hood is provided with several first air inlet holes; the first air outlet and the third air outlet are connected to a first air outlet hood; and the first air outlet hood is provided with several first air outlet holes.

12. The neck fan according to claim 10, wherein the second fan assembly comprises a second fan shell, a second motor fixedly mounted inside the second fan shell, and a second fan blade mounted on a rotating shaft of the second motor; the second fan shell is provided with a fourth air inlet, a second air duct, and a fourth air outlet; and the second air inlet, the fourth air inlet, the second air duct, the fourth air outlet, the second air guide chamber, and the first air outlet are connected to each other in sequence.

13. The neck fan according to claim 12, wherein the second air inlet and the fourth air inlet are connected to a second air inlet hood; the second air inlet hood is provided with several second air inlet holes; the second air outlet and the fourth air outlet are connected to a second air outlet hood; and the second air outlet hood is provided with several second air outlet holes.

14. The neck fan according to claim 13, wherein the hanging shell is a U-shaped hanging shell; the hanging shell comprises a first bracket and a second bracket; and the first bracket is detachably connected to the second bracket.

15. The neck fan according to claim 14, wherein the first air guide chamber is located inside the first bracket; the first bracket is further provided with a first mounting chamber; and the first power supply assembly is located inside the first mounting chamber.

16. The neck fan according to claim 14, wherein the second air guide chamber is located inside the second bracket; the second bracket is further provided with a second mounting chamber; and the second power supply assembly is located inside the second mounting chamber.

17. The neck fan according to claim 14, wherein the first bracket is further provided with a first button switch, a first charging interface, and a first indicator lamp module; and the first button switch, the first charging interface, and the first indicator lamp module are all electrically connected to the first power supply assembly.

18. The neck fan according to claim 14, wherein the second bracket is further provided with a second button switch, a second charging interface, and a second indicator lamp module; and the second button switch, the second charging interface, and the second indicator lamp module are all electrically connected to the second power supply assembly.

19. The neck fan according to claim 1, wherein the inner end portion is connected to at least one flexible cushion.

* * * * *